US011903509B2

(12) United States Patent
Kim

(10) Patent No.: US 11,903,509 B2
(45) Date of Patent: Feb. 20, 2024

(54) PILLOW CONTAINING LATEX BALLS

(71) Applicant: Chung Soo Kim, Seoul (KR)

(72) Inventor: Chung Soo Kim, Seoul (KR)

( * ) Notice: Subject to any disclaimer, the term of this patent is extended or adjusted under 35 U.S.C. 154(b) by 0 days.

(21) Appl. No.: 18/225,877

(22) Filed: Jul. 25, 2023

(65) Prior Publication Data

US 2024/0023733 A1 Jan. 25, 2024

(30) Foreign Application Priority Data

Jul. 25, 2022 (KR) ..... 10-2022-0092034

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ..... A47G 9/10; A47G 9/1009; A47G 2009/1018; A47C 27/20; A47C 27/14; A47C 27/142; A47C 27/144; A47C 27/148
See application file for complete search history.

(56) References Cited

U.S. PATENT DOCUMENTS

| | | | | | |
|---|---|---|---|---|---|
| 5,304,271 | A * | 4/1994 | Gusakov | A47G 9/10 | 156/290 |
| 2008/0016621 | A1* | 1/2008 | Chung | A47G 9/007 | 5/636 |
| 2014/0283304 | A1* | 9/2014 | Chambers | A47G 9/10 | 5/636 |
| 2019/0038043 | A1* | 2/2019 | Fisher | A47C 27/20 | |

FOREIGN PATENT DOCUMENTS

| | | | | |
|---|---|---|---|---|
| EP | 0263065 | A2 * | 4/1988 | A47C 27/20 |
| KR | 2019930002037 | U | 2/1993 | |
| KR | 200173728 | Y1 * | 3/2000 | A47G 9/007 |
| KR | 200322161 | Y1 * | 8/2003 | E04F 15/16 |
| KR | 100870535 | B1 * | 11/2008 | A47C 27/144 |
| KR | 20090052406 | A * | 5/2009 | A47C 3/16 |
| KR | 1020090078224 | A | 7/2009 | |
| KR | 1020110106044 | A | 9/2011 | |

* cited by examiner

*Primary Examiner* — Justin C Mikowski
*Assistant Examiner* — Alison N Labarge

(57) ABSTRACT

A pillow containing latex balls which includes a cover and latex balls filled in the cover, wherein the latex balls are connected to each other horizontally or vertically.

9 Claims, 12 Drawing Sheets

PILLOW CONTAINING LATEX BALLS

CROSS-REFERENCE TO RELATED APPLICATION

This application claims the benefit of priority to Korean Patent Application No. 10-2022-0092034 filed on Jul. 25, 2022, which is herein incorporated by reference in its entirety.

TECHNICAL FIELD

The present invention relates to a pillow and more particularly to a pillow containing latex balls, in which the latex balls are regularly arranged to stably support the head of a pillow user.

BACKGROUND OF THE INVENTION

In general, a pillow is a tool for maintaining a comfortable posture by supporting the head at an appropriate height when a person lies down to sleep or rest. A pillow has been used for a long time and is still used by most people.

Although materials such as cotton have been widely used in a pillow, pillows made of latex-based synthetic resin or synthetic resin foam are gaining popularity recently.

As a prior art of such a pillow using latex, a pillow filled with latex grains has been disclosed in Republic of Korea Patent Publication No. 10-2011-0106044. This conventional pillow includes a pillow cloth and latex grains filling the pillow cloth.

However, in the conventional pillow, since the latex grains are irregularly arranged, there is a problem in that a user's head cannot be supported elastically.

PRIOR ART LITERATURE

Patent Literature (Patent Document 1) Korean Patent Publication No. 10-2011-0106044

SUMMARY OF THE INVENTION

Problem to be Solved

An object of the present invention is to provide a pillow containing latex balls in which the latex balls are regularly arranged to stably support the head of a pillow user.

In addition, it is an object of the present invention to provide a pillow containing latex balls that can prevent deformation of the pillow due to long-term use.

In addition, the objectives of the present invention are not limited to the objectives mentioned above, and other technical advantages not mentioned will be clearly understood by those skilled in the art from the description below.

Means to Solve Problems

A pillow containing latex balls according to an embodiment for solving the above problems includes a cover and latex balls which are filled in the cover. The latex balls are connected to each other horizontally or vertically.

Each of the latex balls may be formed with a diameter of 20 to 50 mm.

A given latex ball, which is one of the latex balls, may include a top vertical elastic groove and a bottom vertical elastic groove. The top vertical elastic groove extends in a direction from the top of the given latex ball to the center of the given latex ball. The bottom vertical elastic groove extends in a direction from the bottom of the given latex ball to the center of the given latex ball.

The given latex ball may further include a left horizontal elastic groove and a right horizontal elastic groove. The left horizontal elastic groove extends in a direction from the left of the given latex ball to the center of the given latex ball. The right horizontal elastic groove extends in a direction from the right of the given latex ball to the center of the given latex ball.

The given latex ball may further include a horizontal wing. The horizontal wing is provided on a circumference of the given latex ball and located on a first plane. The first plane passes through the center of the given latex ball and is perpendicular to a vertical axis. The vertical axis extends from the top to the bottom of the given latex ball.

The given latex ball may further include a vertical wing. The vertical wing is provided on a circumference of the given latex ball and located on a second plane. The second plane passes through the center of the given latex ball and is parallel to the vertical axis.

In addition, the given latex ball may further include a horizontal connection unit. The horizontal connection unit connects the given latex ball to a first neighboring latex ball in a horizontal direction. The horizontal direction is perpendicular to the vertical axis.

The horizontal connection unit includes (i) a horizontal connector; (ii) a horizontal connection groove formed on the given latex ball; and (iii) a neighboring horizontal connection groove formed on the first neighboring latex ball.

The horizontal connector is in a bar shape. An outer surface of the horizontal connector (i) has a repeated shape of peaks and valleys or (ii) has multiple protruding patterns.

In addition, the given latex ball may further include a vertical connection unit. The vertical connection unit connects the given latex ball to a second neighboring latex ball in a vertical direction. The vertical direction is parallel to the vertical axis.

The vertical connection unit includes (i) a vertical connector; (ii) a vertical connection groove formed on the given latex ball; and (iii) a neighboring vertical connection groove formed on the second neighboring latex ball.

The vertical connector is in a bar shape. An outer surface of the vertical connector (i) has a repeated shape of peaks and valleys or (ii) has multiple protruding patterns.

In addition, the given latex ball may further include a diagonal connection unit. The diagonal connection unit connects the given latex ball to a third neighboring latex ball in a diagonal direction. The diagonal direction extends between the horizontal direction and the vertical direction.

The diagonal connection unit (150) includes (i) a diagonal connector (151); (ii) a diagonal connection groove (152) formed on the given latex ball; and (iii) a neighboring diagonal connection groove (152) formed on the third neighboring latex ball.

The diagonal connector is in a bar shape. An outer surface of the diagonal connector (i) has a repeated shape of peaks and valleys or (ii) has multiple protruding patterns.

Effects of the Invention

In a pillow containing latex balls according to an embodiment of the present invention, the latex balls are regularly arranged to stably support the head of a pillow user.

In addition, deformation of the pillow due to long-time use can be prevented.

Advantages according to the embodiments are not limited by the contents exemplified above, and more various advantages are included in the present specification.

DETAILED DESCRIPTION OF THE INVENTION

Advantages and features of the present invention and methods for achieving them will become clear with reference to the embodiments described below in detail in conjunction with the accompanying drawings. It should be understood that the present invention is not limited to the embodiments disclosed below but can be modified in various forms. These embodiments are mere examples of the present invention to help understanding by a person having an ordinary skill in the art. The scope of the present invention is determined by the claims.

Hereinafter, specific embodiments will be described with reference to the accompanying drawings.

Figure 1:
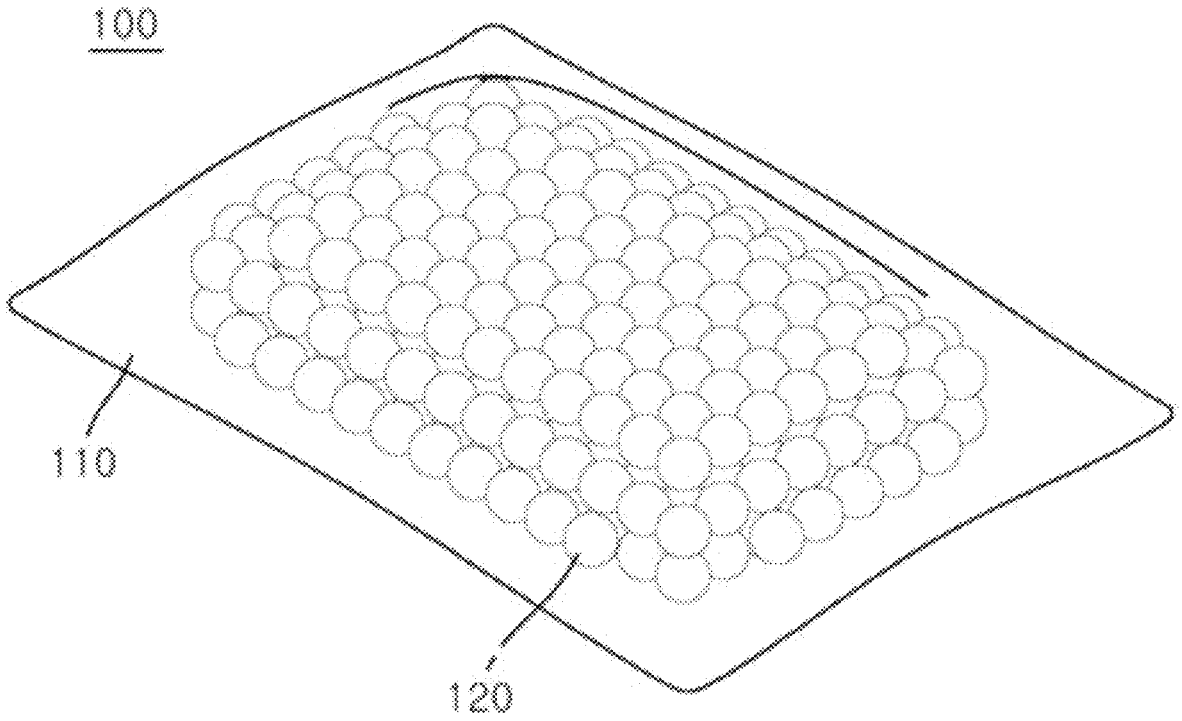
FIG. 1 is a view showing a pillow containing latex balls according to an embodiment of the present invention.
Figure 2:
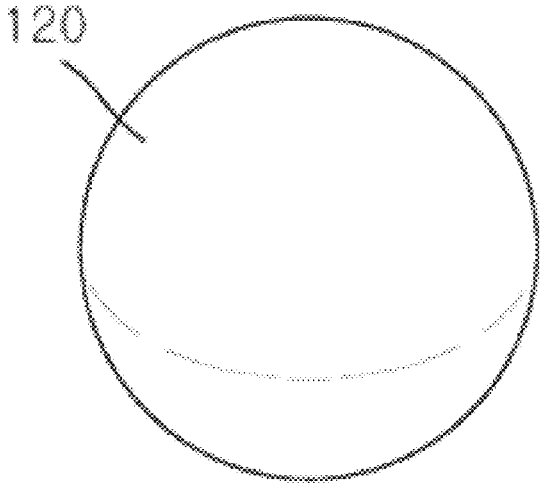
FIGS. 2-8 are views showing a given latex ball, which is one of the latex balls contained in the pillow, according to an embodiment of the present invention, respectively.

FIG. 1 is a view showing a pillow containing latex balls according to an embodiment of the present invention.

Referring to FIG. 1, a pillow containing latex balls (100) according to an embodiment includes a cover (110) and latex balls (120).

In some embodiments, the cover (110) may accommodate the latex balls (120). In some embodiments, the cover (110) may be formed of a fiber, but is not limited thereto, and in some embodiments, the cover (110) may be formed of a soft material.

In some embodiments, the cover (110) may include a first space. In some embodiments, the first space may be formed inside the cover (110) and filled with the latex balls (120).

In some embodiments, the cover (110) may include a second space. In some embodiments, the second space is disposed above the first space. In some embodiments, the second space may be formed by dividing the first space. In some embodiments, the latex balls (120) filled in the second space may have a relatively smaller size than the latex balls (120) filled in the first space. However, it is not limited thereto, and in some embodiments, the latex balls (120) filled in the second space may be relatively larger than the latex balls (120) filled in the first space.

In some embodiments, the cover (110) may include a third space. In some embodiments, the third space is disposed below the first space. In some embodiments, the third space may be formed by dividing the first space. In some embodiments, the latex balls (120) filled in the third space may be relatively smaller in size than the latex balls (120) filled in the first space. However, it is not limited thereto, and in some embodiments, the latex balls (120) filled in the third space may be relatively larger in size than the latex balls (120) filled in the first space. In some embodiments, the sizes of the latex balls (120) filled in the third space and the second space may be the same as or different from each other.

Referring to FIGS. 2-8, in some embodiments, the latex balls (120) may be filled in the space of the cover (110). In some embodiments, the latex balls (120) may be connected to each other horizontally or vertically. In some embodiments, the latex balls (120) may be formed between the vertically connected latex balls (120). In some embodiments, the latex ball (120) may be a memory foam made of a 100% elastic natural latex material. The memory foam is advantageous in that it is optimized for the flow and body pressure distribution of a pillow user. In some embodiments, each of the latex balls (120) may be formed in a circular shape with a diameter of 20 to 50 mm. However, the diameter is not limited thereto. Each of the latex balls (120) may have various diameters and various shapes. For example, when the diameter of each of the latex balls (120) is less than 20 mm, it is difficult for the latex balls (120) to be arranged in a connected manner in the space of the cover (110). When the diameter of each of the latex balls (120) is more than 50 mm, a space between neighboring latex balls (120, 120*a*) is too big, making a pillow user feel uncomfortable. In some embodiments, the density of each of the latex balls (120) may be 1 to 5 g to absorb shock and hold the head of a pillow user.

Figure 3:
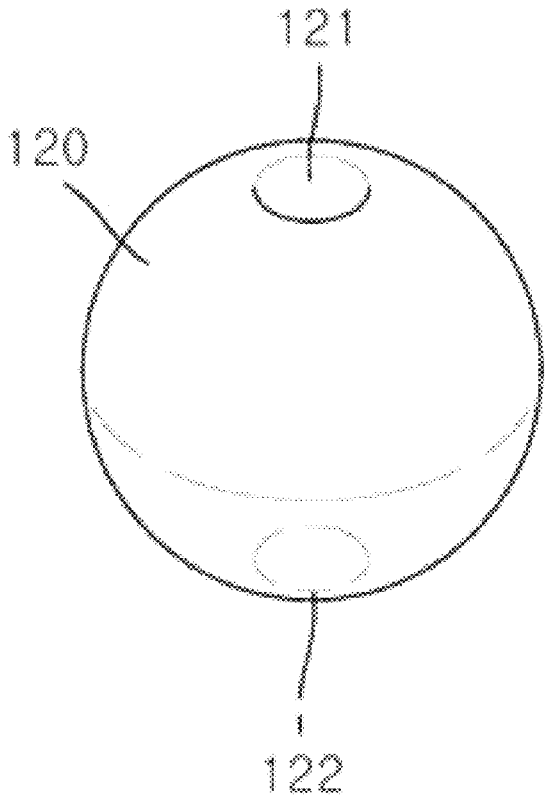
Figure 4:
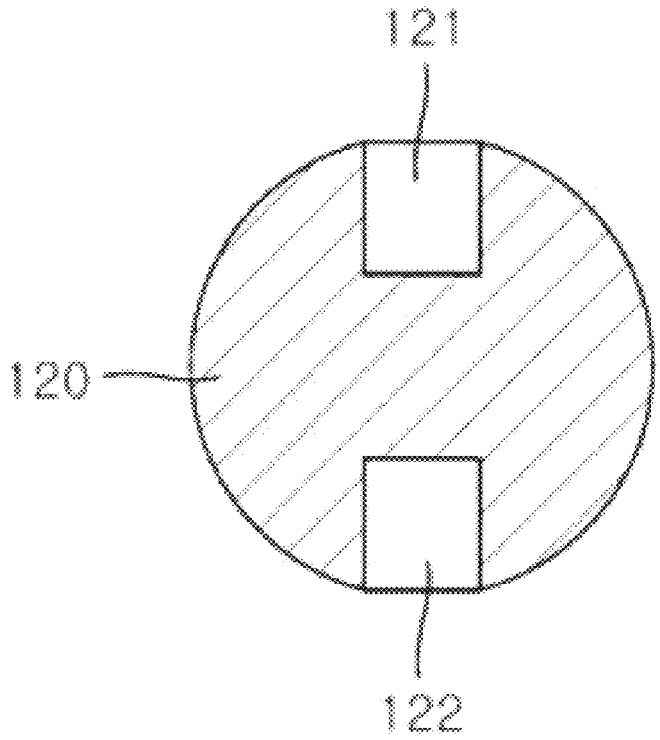

In some embodiments, a given latex ball, which is one of the latex balls (120), may further include an elastic groove. The elastic groove includes at least one of: a top vertical elastic groove (121), a bottom vertical elastic groove (122), a left horizontal elastic groove (123), a right horizontal elastic groove (124), and a horizontal wing (125). Referring to FIGS. 3 and 4, in some embodiments, the elastic groove may include a top vertical elastic groove (121). The top vertical elastic groove (121) extends in a direction from the top of the given latex ball to the center of the given latex ball. In some embodiments, the top vertical elastic groove (121) may be formed with a width of 5 to 15 mm. For example, the top vertical elastic groove (121) may be formed with a width of 10 mm, but is not limited thereto, and in some embodiments, the top vertical elastic groove (121) may be formed with various widths. In some embodiments, the depth of the top vertical elastic groove (121) may be greater than the width of the top vertical elastic groove (121). For example, when the width of the latex ball (120) is 40 mm and the width of the top vertical elastic groove (121) is 10 mm, the depth of the top vertical elastic groove (121) may be formed to be 10-20 mm. When the depth of the top vertical elastic groove (121) is larger than the width of the top vertical elastic groove (121), the given latex ball can be easily deformed by the weight of a user's head and thus can elastically support the user's head.

In some embodiments, the elastic groove may further include a bottom vertical elastic groove (122). The bottom vertical elastic groove (122) extends in a direction from the bottom of the given latex ball (120) to the center of the given latex ball (120). In some embodiments, the bottom vertical elastic groove (122) may be formed with a width of 5 to 15 mm. For example, the bottom vertical elastic groove (122) may be formed with a width of 10 mm, but is not limited thereto, and in some embodiments, the bottom vertical elastic groove (122) may be formed with various diameters. In some embodiments, the depth of the bottom vertical elastic groove (122) may be greater than the width of the bottom vertical elastic groove (122). For example, when the width of the latex ball (120) is 40 mm and the width of the bottom vertical elastic groove (122) is 10 mm, the depth of the bottom vertical elastic groove (122) may be formed to be 10-20 mm. When the depth of the bottom vertical elastic groove (122) is larger than the width of the bottom vertical elastic groove (122), the given latex ball can be easily deformed by the weight of a user's head and thus can elastically support the user's head.

In some embodiments, the width of the top vertical elastic groove (121) and the width of the bottom vertical elastic groove (122) may be formed to be the same, but is not limited thereto. The width of the top vertical elastic groove (121) may be larger or smaller than the width of the bottom vertical elastic groove (122).

In addition, in some embodiments, the top vertical elastic groove (121) and the bottom vertical elastic groove (122) may be aligned with each other along a vertical axis, but are not limited thereto. In some embodiments, the top vertical elastic groove (121) and the bottom vertical elastic groove (122) may not be aligned with each other along the vertical axis. The vertical axis extends from the top to the bottom of the given latex ball.

Figure 5:
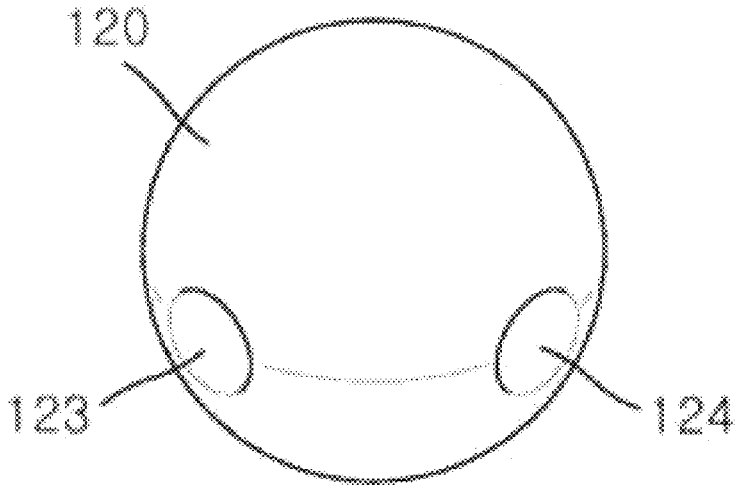
Figure 6:
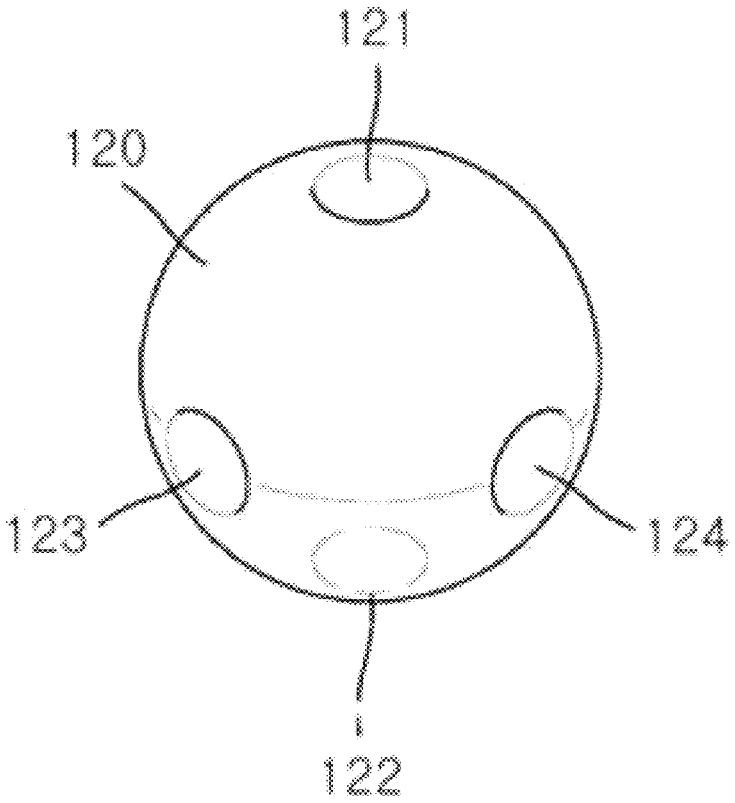

Referring to FIGS. 5 and 6, in some embodiments, the elastic groove may further include a left horizontal elastic groove (123). In some embodiments, the left horizontal elastic groove (123) extends in a direction from the left of the given latex ball (120) to the center of the given latex ball (120). In some embodiments, the left horizontal elastic groove (123) may be formed with a width of 5 to 15 mm. For example, the left horizontal elastic groove (123) may be formed with a width of 10 mm, but is not limited thereto, and in some embodiments, the left horizontal elastic groove (123) may be formed with various widths. In some embodiments, the depth of the left horizontal elastic groove (123) may be greater than the width of the left horizontal elastic groove (123). For example, when the width of the latex ball (120) is 40 mm and the width of the left horizontal elastic groove (123) is 10 mm, the depth of the left horizontal elastic groove (123) may be formed to be 10-20 mm. When the depth of the left horizontal elastic groove (123) is larger than the width of the left horizontal elastic groove (123), the given latex ball can be easily deformed by the weight of a user's head and thus can elastically support the user's head.

In some embodiments, the elastic groove may further include a right horizontal elastic groove (124). The right horizontal elastic groove (124) extends in a direction from the right of the given latex ball (120) to the center of the given latex ball (120). In some embodiments, the right horizontal elastic groove (124) may be formed with a width of 5 to 15 mm. For example, the right horizontal elastic groove (124) may be formed with a width of 10 mm, but is not limited thereto, and in some embodiments, the right horizontal elastic groove (124) may be formed with various widths. In some embodiments, the depth of the right horizontal elastic groove (124) may be larger than the width of the right horizontal elastic groove (124). For example, when the width of the latex ball (120) is 40 mm and the width of the right horizontal elastic groove (124) is 10 mm, the depth of the right horizontal elastic groove (124) may be formed to be 10-20 mm. When the depth of the right horizontal elastic groove (124) is larger than the width of the right horizontal elastic groove (124), the given latex ball can be easily deformed by the weight of a user's head and thus can elastically support the user's head.

In some embodiments, the width of the left horizontal elastic groove (123) and the width of the right horizontal elastic groove (124) may be formed to be the same, but is not limited thereto. The width of the left horizontal elastic groove (123) may be larger or smaller than the width of the right horizontal elastic groove (124).

In addition, in some embodiments, the left horizontal elastic groove (123) and the right horizontal elastic groove (124) may be aligned with each other along a horizontal axis which is perpendicular to the vertical axis, but are not limited thereto.

In some embodiments, the left horizontal elastic groove (123) and the right horizontal elastic groove (124) may not be aligned with each other along the horizontal axis.

Also, in some embodiments, the elastic groove may be inclined. For example, the elastic groove may be disposed inclined at 45 degrees, but is not limited thereto, and may be disposed inclined at various angles.

Figure 7:
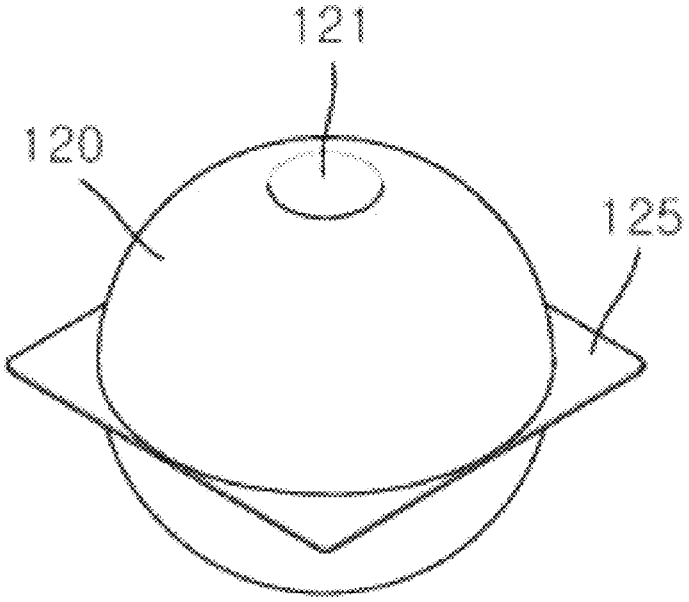

Referring to FIG. 7, in some embodiments, the given latex ball (120) may further include a horizontal wing (125). In some embodiments, the horizontal wing (125) is provided on a circumference of the given latex ball and located on a first plane. The first plane passes through the center of the given latex ball and is perpendicular to the vertical axis. In some embodiments, the horizontal wing (125) may be disposed in a square shape. That is, the horizontal wing (125), which is disposed in a square shape on the outer circumferential surface of the given latex ball (120), can enhance the supporting force and fixing force between the given latex ball (120) and a first neighboring latex ball (120*a*). The given latex ball (120) and the first neighboring latex ball (120*a*) are arranged in the horizontal direction. In addition, in some embodiments, the pillow may further include a horizontal connector. The horizontal connector connects the horizontal wing (125) of the given latex ball (120) and the horizontal wing (125) of the first neighboring latex ball (120*a*).

Figure 8:
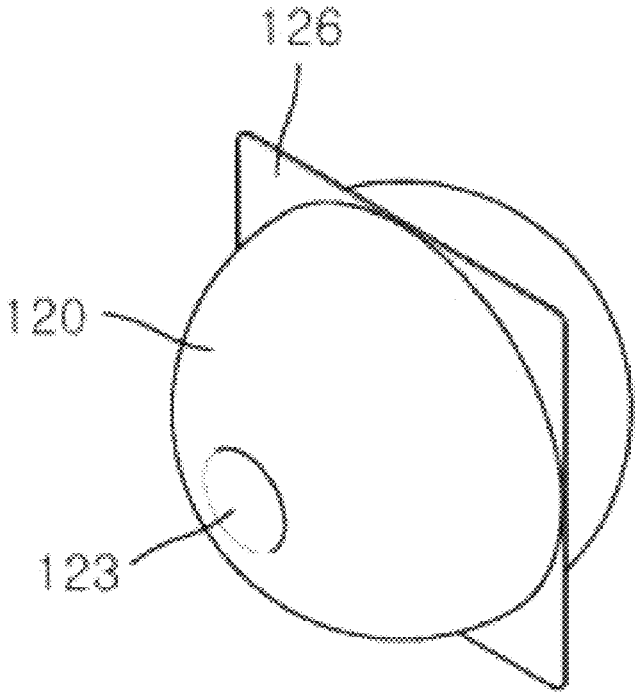

Referring to FIG. 8, in some embodiments, the given latex ball (120) may further include a vertical wing (126). In some embodiments, the vertical wing (126) is provided on a circumference of the given latex ball and located on a second plane. The second plane passes through the center of the given latex ball and is parallel to the vertical axis. In some embodiments, the vertical wing (126) may be disposed in a square shape. That is, the vertical wing (126), which is disposed in a square shape on the outer circumferential surface of the given latex ball (120), can enhance the supporting force and fixing force between the given latex ball (120) and a second neighboring latex ball (120*b*). The given latex ball (120) and the second neighboring latex ball (120*b*) are arranged in the vertical direction. In addition, in some embodiments, the pillow may further include a vertical connector. The vertical connector connects the vertical wing (126) of the given latex ball (120) and the vertical wing (126) of the second neighboring latex ball (120*b*).

Figure 9:
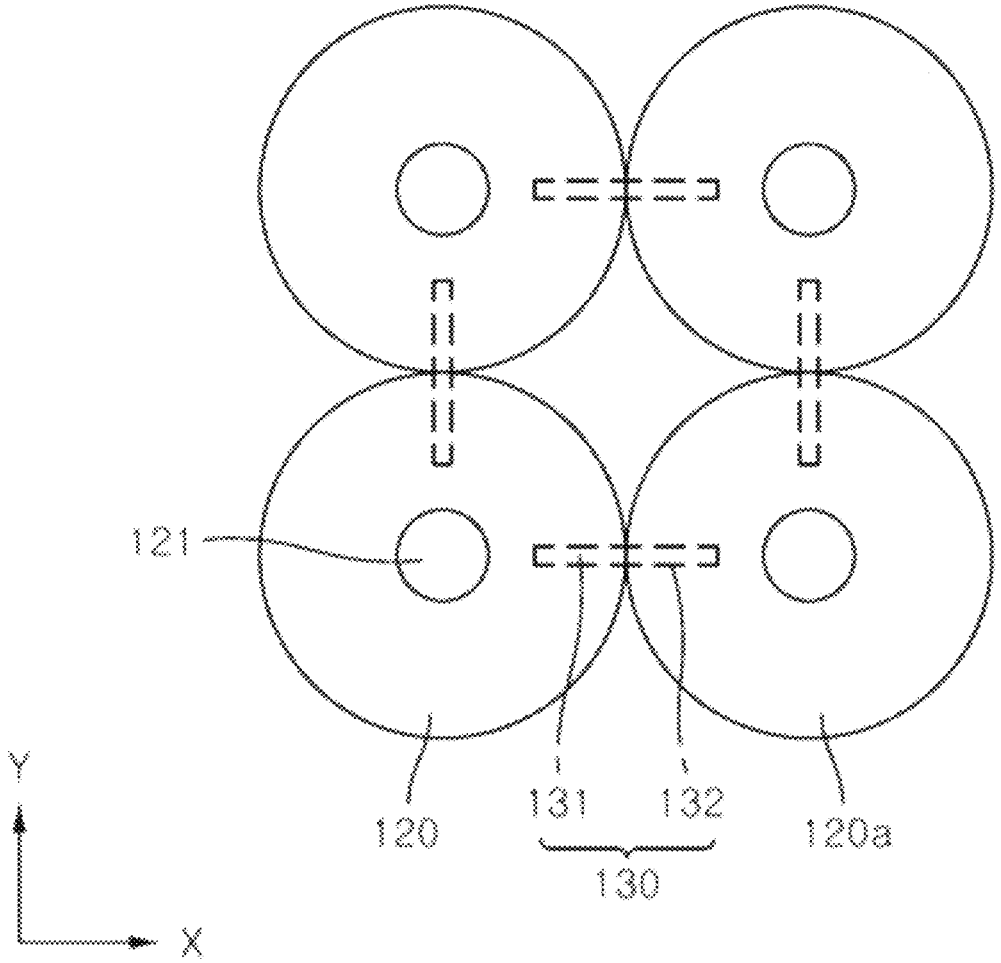
FIGS. 9-12 are views showing how the latex balls are connected to each other using connectors, respectively.

Referring to FIG. 9, in some embodiments, the pillow containing latex balls (100) may further include a horizontal connection unit (130). In some embodiments, the horizontal connection unit (130) may connect the latex ball (120) and the first neighboring latex ball (120*a*) arranged horizontally, e. g., on an XY-plane as shown in FIG. 9. In some embodiments, the horizontal connection unit (130) may include the horizontal connector (131) and a horizontal connection groove (132). In some embodiments, the horizontal connector (131) may extend in a bar shape. For example, the horizontal connector (131) may be in a cylindrical shape. However, it is not limited thereto, and in some embodiments, the horizontal connector (131) may be formed of various pillar shapes such as a square pillar, a hexagonal pillar, and an octagonal pillar.

In some embodiments, the horizontal connector (131) may be formed in a hollow bar shape. In some embodiments, the horizontal connector (131) may be formed by a combination of different shapes. For example, a central portion of the horizontal connector (131) may have a cylindrical shape, but each of both end portions of the horizontal connector (131) may have a rectangular pillar shape. In the following embodiment, the horizontal connector (131) is a cylinder, but the present invention is not limited thereto.

In some embodiments, the length of the horizontal connector (131) may be smaller than the diameter of the given latex ball (120). Therefore, the latex balls (120) are arranged with each other horizontally by the horizontal connector (131). The given latex ball (120) and the first neighboring latex ball (120*a*) come in close contact by the horizontal connector (131). In addition, the horizontal wing (125) of the given latex ball (120) and the horizontal wing (125) of the first neighboring latex ball (120*a*) come in close contact. As a result, the supporting force and the fixing force of the pillow are enhanced. In an embodiment, the length of the horizontal connector (131) may be larger than the diameter of the given latex ball (120).

In some embodiments, an outer surface of the horizontal connector (131) (*i*) has a repeated shape of peaks and valleys or (ii) has multiple protruding patterns. In that case, the restoring force of the horizontal connector (131) can be enhanced while the horizontal connector (131) connects the given latex ball (120) and the first neighboring latex ball (120*a*).

In some embodiments, the horizontal connection groove (132) may be a groove to which the horizontal connector (131) is coupled. In some embodiments, the horizontal connection groove (132) may extend in a direction from the outer circumferential surface of the given latex ball (120) facing the first neighboring latex ball (120*a*) to the center of the given latex ball (120). In some embodiments, the horizontal connection groove (132) may have protrusions on the inner surface thereof. For example, the protrusions may regularly or irregularly protrude from the inner surface of the horizontal connection groove (132) and guide the horizontal connector (131) to couple with the horizontal connection groove (132). In addition, the protrusions press the outer surface of the horizontal connector (131) to prevent deformation of the horizontal connector (131). In some embodiments, each of the protrusions may be in a semi-circular shape. However, it is not limited thereto, and each of the protrusions may be in various shapes.

Figure 10:
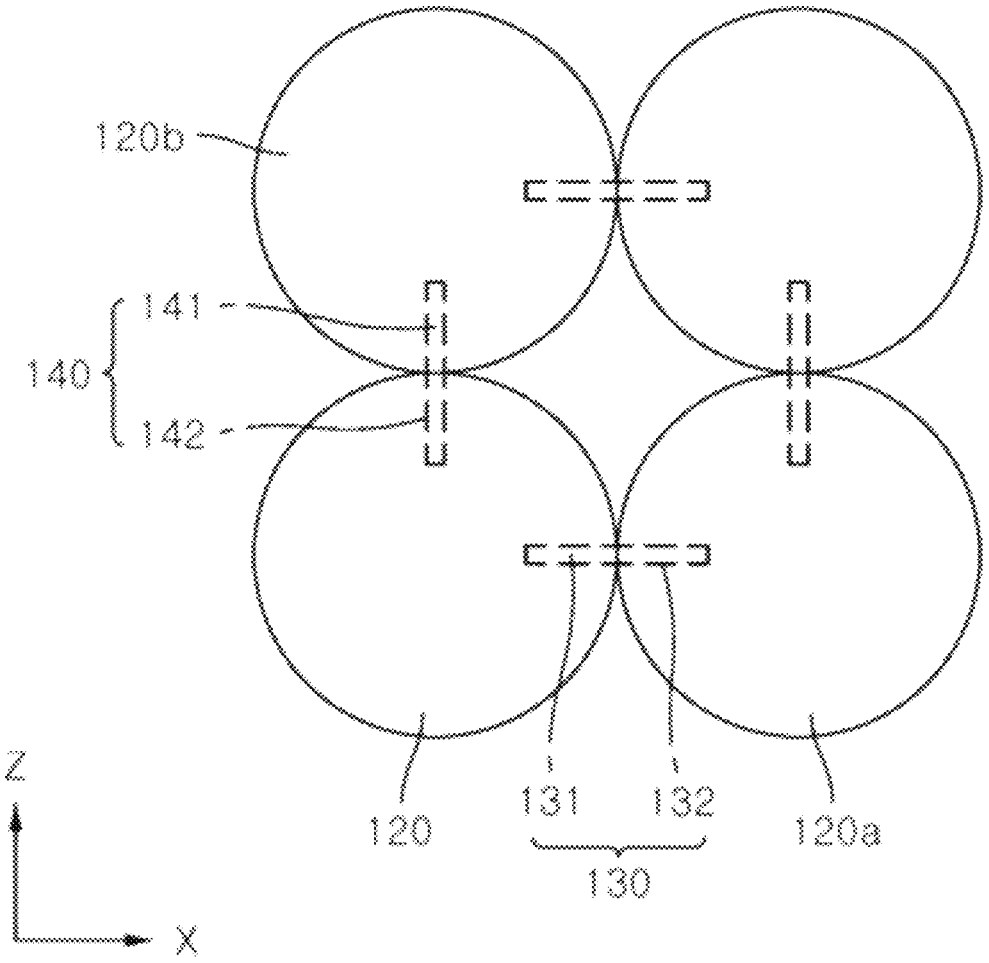

Referring to FIG. 10, in some embodiments, the pillow containing latex balls (100) may further include a vertical connection unit (140). In some embodiments, the vertical connector (140) may connect the latex ball (120) and the second neighboring latex ball (120*b*) arranged vertically, e. g., on a XZ-plane which is perpendicular to the XY-plane as shown in FIG. 10. In some embodiments, the vertical connection unit (140) may include the vertical connector (141) and a vertical connection groove (142).

In some embodiments, the vertical connector (141) may extend in a bar shape. For example, the vertical connector (141) may be in a cylindrical shape. However, it is not limited thereto, and in some embodiments, the vertical connector (141) may be formed of various pillar shapes such as a square pillar, a hexagonal pillar, and an octagonal pillar. In some embodiments, the vertical connector (141) may be formed in a hollow bar shape. In some embodiments, the vertical connector (141) may be formed by a combination of different shapes. For example, a central portion of the vertical connector (141) may have a cylindrical shape, but each of both end portions of the vertical connector (141) may have a rectangular pillar shape. In the following embodiment, the vertical connector (141) is a cylinder, but the present invention is not limited thereto.

In some embodiments, the length of the vertical connector (141) may be smaller than the diameter of the given latex ball (120). Therefore, the latex balls (120) are arranged with each other vertically by the vertical connector (141). The given latex ball (120) and the first neighboring latex ball (120*a*) come in close contact by the vertical connector (141). In addition, the vertical wing (125) of the given latex ball (120) and the vertical wing (125) of the second neighboring latex ball (120*b*) come in close contact. As a result, the supporting force and the fixing force of the pillow are enhanced. In an embodiment, the length of the vertical connector (141) may be larger than the diameter of the given latex ball (120).

In some embodiments, an outer surface of the vertical connector (141) (*i*) has a repeated shape of peaks and valleys or (ii) has multiple protruding patterns. In that case, the restoring force of the vertical connector (141) can be enhanced while the vertical connector (141) connects the given latex ball (120) and the second neighboring latex ball (120*b*).

In some embodiments, the vertical connection groove (142) may be a groove to which the vertical connection member (141) is coupled. In some embodiments, the vertical connection groove (142) may extend in a direction from the outer circumferential surface of the given latex ball (120) facing the second neighboring latex ball (120*b*) to the center of the given latex ball (120). In some embodiments, the vertical connection groove (142) may have protrusions on the inner surface thereof. For example, the protrusions may regularly or irregularly protrude from the inner surface of the vertical connection groove (142) and guide the vertical connector (141) to couple with the vertical connection groove (142).

In addition, the protrusions press the outer surface of the vertical connector (141) to prevent deformation of the vertical connector (141). In some embodiments, each of the protrusions may be in a semi-circular shape. However, it is not limited thereto, and each of the protrusions may be in various shapes.

Figure 11:
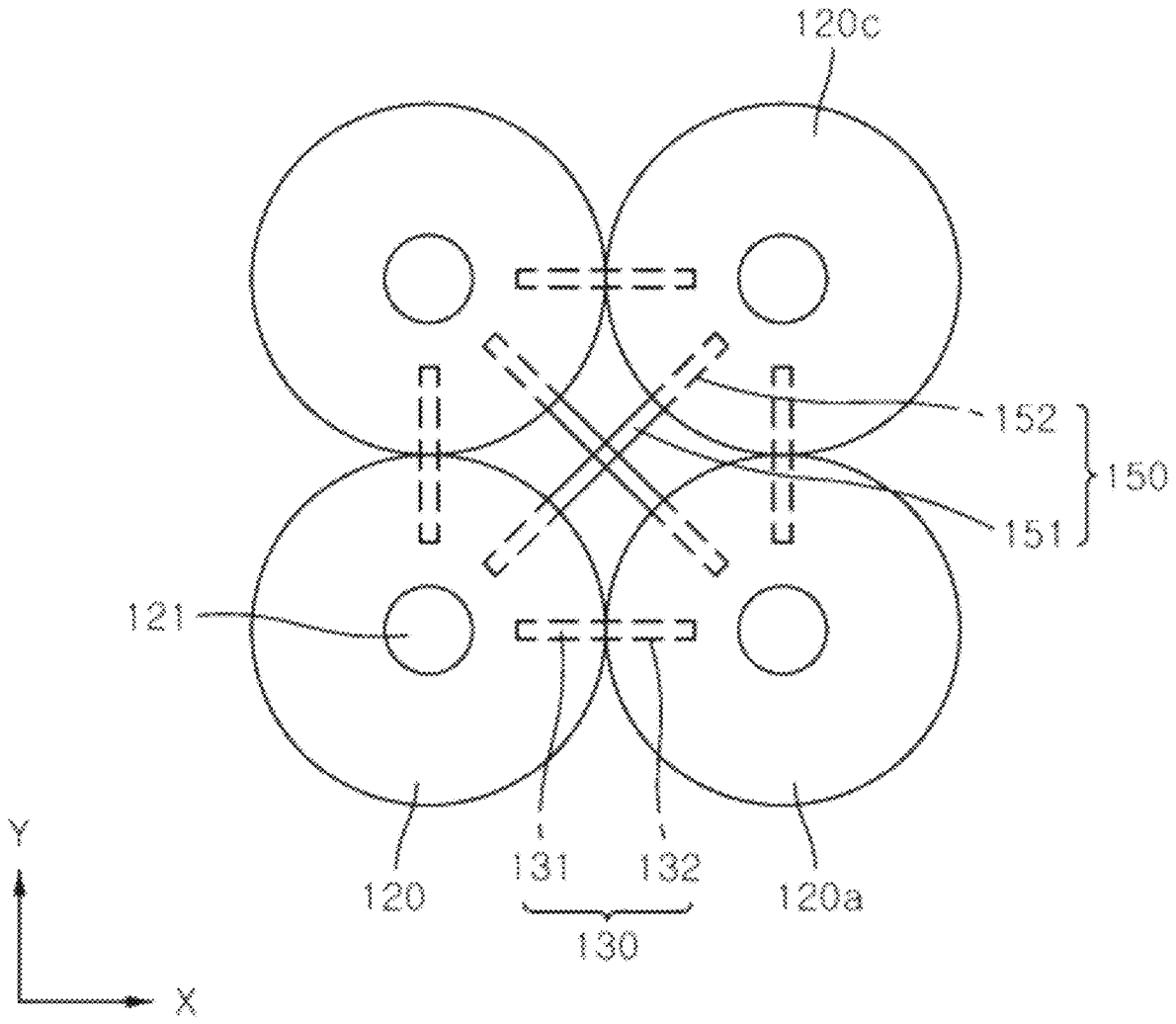
Figure 12:
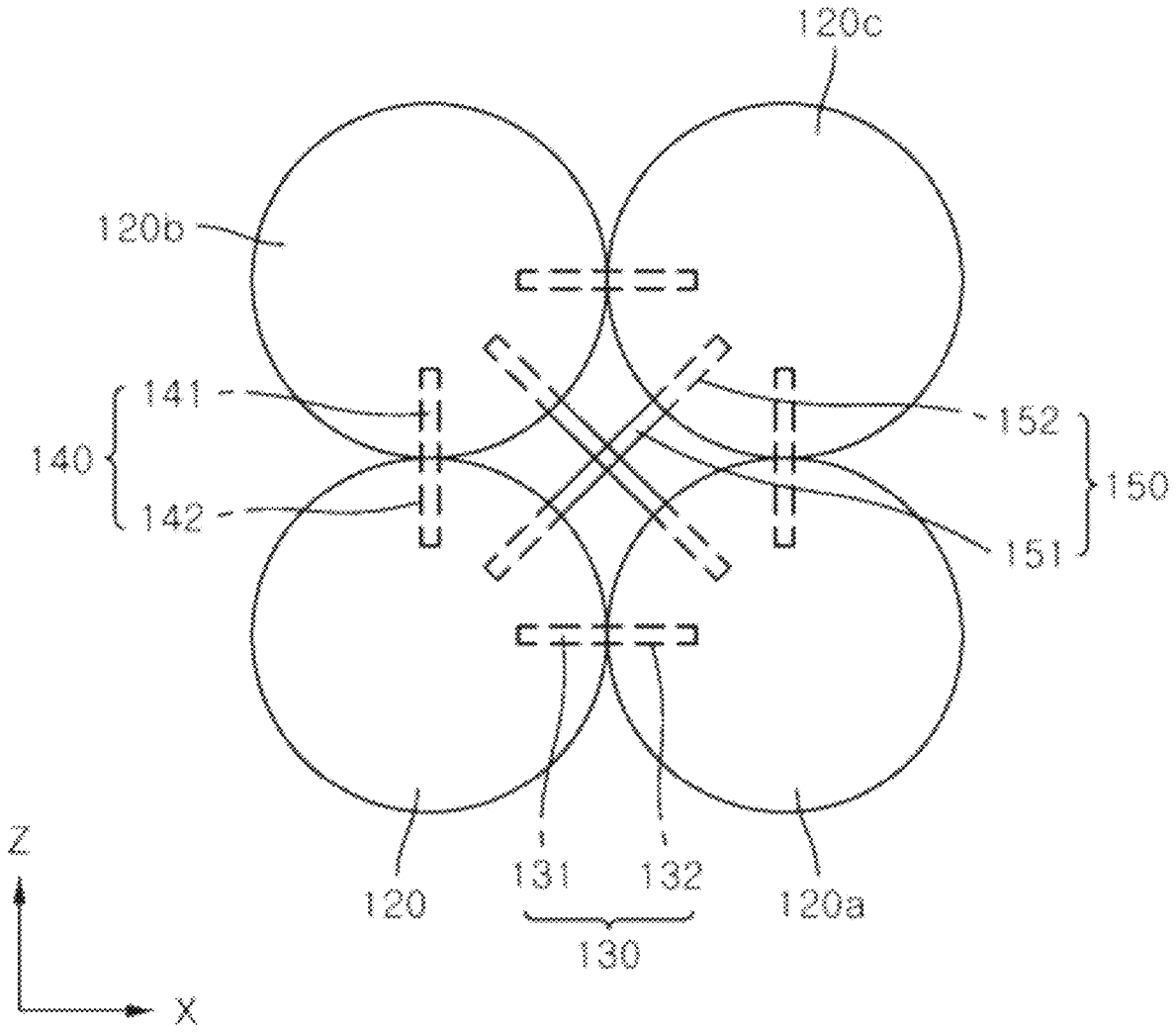

Referring to FIGS. 11 and 12, in some embodiments, the pillow containing latex balls (100) may further include a diagonal connection unit (150). In some embodiments, the diagonal connection unit (150) may connect the given latex ball (120) and the third neighboring latex ball (120*c*) arranged in the diagonal direction on the XY-plane and/or the XZ-plane. In some embodiments, the diagonal connection unit (150) may include the diagonal connector (151) and a diagonal connection groove (152).

In some embodiments, the diagonal connector (151) may extend in a bar shape. For example, the diagonal connector (151) may be in a cylindrical shape. However, it is not limited thereto, and in some embodiments, the diagonal connector (151) may be formed of various pillar shapes such as a square pillar, a hexagonal pillar, and an octagonal pillar. In some embodiments, the diagonal connector (151) may be formed in a hollow bar shape. In some embodiments, the diagonal connector (151) may be formed by a combination of different shapes. For example, the central portion of the diagonal connector (151) may have a cylindrical shape, but each of both end portions of the diagonal connector (151) may have a rectangular pillar shape. In the following embodiment, the diagonal connector (151) is a cylinder, but the present invention is not limited thereto.

In some embodiments, the length of the diagonal connector (151) may be smaller than the diameter of the given latex ball (120). Therefore, the latex balls (120) are arranged with each other diagonally by the diagonal connector (151). The given latex ball (120) and the third neighboring latex ball (120*c*) come in close contact by the diagonal connector (151). In addition, the horizontal wing (125) of the first neighboring latex ball (120*a*) and the vertical wing (126) of the second neighboring latex ball (120*b*) come in close contact. As a result, the supporting force and the fixing force of the pillow are enhanced. In an embodiment, the length of the diagonal connector (151) may be larger than the diameter of the given latex ball (120).

In some embodiments, an outer surface of the diagonal connector (141) (*i*) has a repeated shape of peaks and valleys or (ii) has multiple protruding patterns. In that case, the restoring force of the diagonal connector (151) can be enhanced while the diagonal connector (151) connects the given latex ball (120) and the third neighboring latex ball (120*c*).

In some embodiments, the diagonal connection groove (152) may be a groove to which the diagonal connector (151) is coupled. In some embodiments, the diagonal connection groove (152) may extend in a direction from the outer circumferential surface of the given latex ball (120) facing the third neighboring latex ball (120*c*) to the center of the given latex ball (120). In some embodiments, the diagonal connection groove (152) may have protrusions on the inner surface thereof. For example, the protrusions may regularly or irregularly protrude from the inner surface of the diagonal connection groove (152) and guide the diagonal connector (151) to couple with the diagonal connection groove (152). In addition, the protrusions press the outer surface of the diagonal connector (151) to prevent deformation of the diagonal connector (151). In some embodiments, each of the protrusions may be in a semi-circular shape. However, it is not limited thereto, and each of the protrusions may be in various shapes.

Although the embodiments of the present invention have been described with reference to the accompanying drawings, those skilled in the art to which the present invention pertains will be able to understand that the present invention can be modified without changing the technical spirit or essential features of the present invention. Therefore, the embodiments described above should be understood in the illustrative purpose and not in the limiting purpose.

EXPLANATION OF CODE

100: pillow containing latex balls
110: cover
120: latex balls
120*a*, 120*b*: first neighboring latex ball, second neighboring latex ball
121: top vertical elastic groove
122: bottom vertical elastic groove
123: left horizontal elastic groove
124: right horizontal elastic groove
125: horizontal wing
126: vertical wing
130: horizontal connection unit
131: horizontal connector
132: horizontal connection groove
140: vertical connection unit
141: vertical connector
142: vertical connection groove
150: diagonal connection unit
151: diagonal connector
152: diagonal connection groove

What is claimed is:

1. A pillow containing latex balls, comprising:
a cover;
a first and a second latex ball (120, 120*a*) arranged in a first horizontal direction and filling in the cover;
a first horizontal connection groove (123, 132) formed on the first latex ball (120);
a second horizontal connection groove (123, 132) formed on the second latex ball (120*a*);
a horizontal connector (131) extending between the first horizontal connection groove (123, 132) and the second horizontal connection groove (123, 132), wherein the horizontal connector (131) does not penetrate through either the first latex balls (120) or the second latex ball (120*a*); and
a vertical wing (126) formed on the first latex ball (120),
wherein the vertical wing (126) is provided along a vertical circumference of the first latex ball (120) and located on a vertical plane,
wherein the vertical plane is perpendicular to the first horizontal direction,
wherein each of the first and the second latex balls (120, 120*a*) has a diameter of 20 to 50 mm.

2. The pillow containing latex balls according to claim 1, further comprising:
a horizontal wing (125) formed on the first latex ball (120),
wherein the horizontal wing (125) is provided along a horizontal circumference of the first latex ball (120) and located on a horizontal plane, wherein the horizontal plane is perpendicular to the vertical plane.

3. The pillow containing latex balls according to claim 2, wherein the horizontal connector (131) is in a bar shape.

4. The pillow containing latex balls according to claim 3, further comprising:
a third latex ball (120*b*) provided on the first latex ball in a vertical direction; and
a vertical connector (141) extending between the first latex ball (120) and the third latex ball (120*b*),
wherein the vertical connector (141) does not penetrate through either the first latex ball (120) or the third latex ball (120*b*),
wherein the vertical direction is perpendicular to the first horizontal direction and perpendicular to the horizontal plane.

5. The pillow containing latex balls according to claim 4, further comprising:
a first vertical connection groove (122) formed on the first latex ball (120); and
a second vertical connection groove (122) formed on the third latex ball (120*b*),
wherein the vertical connector (141) extending between the first vertical connection groove (122) and the second vertical connection groove (122).

6. The pillow containing latex balls according to claim 5, wherein the vertical connector (141) is in a bar shape.

7. The pillow containing latex balls according to claim 6, further comprising:
a fourth latex ball (120*c*) provided at the same level as the first and the second latex balls (120, 120*a*) and aligned with the second latex balls (120*a*) in a second horizontal direction, wherein the second horizontal direction is perpendicular to the first horizontal direction and the vertical direction;
a diagonal connector (151) extending between the first latex ball (120) and the fourth latex ball (120*c*) along a diagonal direction, wherein the diagonal direction extends diagonally between the first horizontal direction and the second horizontal direction and is perpendicular to the vertical direction; and a diagonal connector (151) extending between the first latex ball (120) and the fourth latex ball (120*c*) along the diagonal direction, wherein the diagonal connector (151) does not penetrate through either the first latex ball (120) or the fourth latex ball (120*c*).

8. The pillow containing latex balls according to claim 7, further comprising:

a first diagonal connection groove (152) formed on the first latex ball (120); and a second diagonal connection groove (152) formed on the fourth latex ball (120*c*), wherein the diagonal connector (151) extends between the first diagonal connection groove (152) and the second diagonal connection groove (152).

9. The pillow containing latex balls according to claim 8, wherein the diagonal connector (151) is in a bar shape.

* * * * *